United States Patent [19]

Terenzoni

[11] 4,188,066

[45] Feb. 12, 1980

[54] FURNITURE CONSTRUCTION

[76] Inventor: Amerigo Terenzoni, 5721 N.W. 19th, Oklahoma City, Okla. 73127

[21] Appl. No.: 942,367

[22] Filed: Sep. 14, 1978

[51] Int. Cl.[2] ..... A47C 7/00

[52] U.S. Cl. ..... 297/440; 297/218; 297/422

[58] Field of Search ..... 5/280, 462, 463; 297/218, 283, 422, 440, 444, 191, 412, 442, 450, 463; 52/222, 764, 766; 108/12, 13, 90

[56] References Cited

U.S. PATENT DOCUMENTS

| | | | |
|---|---|---|---|
| 390,909 | 10/1888 | Seip | 297/444 X |
| 1,735,162 | 11/1929 | Favour | 108/13 |
| 2,638,971 | 5/1953 | Furman | 5/280 X |
| 2,907,377 | 10/1959 | Hoven et al. | 297/444 |
| 3,170,729 | 2/1965 | Grant | 297/440 |
| 3,563,599 | 2/1971 | Heumann | 297/218 |

*Primary Examiner*—James C. Mitchell

*Attorney, Agent, or Firm*—Laney, Dougherty, Hessin & Beavers

[57] ABSTRACT

An improved furniture construction is provided having a framework designed to receive a series of upholstery panels which are installed merely by press fitting them into place within the framework. The framework includes a side frame having an interior portion with an exterior portion attached to a peripheral edge of said interior portion, said interior and exterior portions defining inner and outer substantially planar cavities having a groove adjacent an edge thereof. Inner and outer upholstery panels are press fit into the cavities. The outer side panel includes a tongue engaging the groove of said outer cavity. Access holes are provided in said interior portion so that said inner and outer panels may be removed.

21 Claims, 15 Drawing Figures

FURNITURE CONSTRUCTION

BACKGROUND OF THE INVENTION

1. Field of the Invention

This invention relates generally to the construction of furniture such as chairs or sofas, and more particularly, but not by way of limitation, to an improved furniture construction having upholstery panels which are installed or removed in a simple and easy manner.

2. Description of the Prior Art

Furniture similar in its external appearance to that of the present invention exists in the prior art, but has not previously been available with the removable upholstery panels as described herein.

The upholstery of furniture of the prior art has typically been of a permanent nature, fixedly attached to the framework of the furniture, so that it could not be removed without actually taking the fabric or other covering off of the framework and thereby destroying the upholstery.

The cost of replacement or repair of upholstery on furniture of the prior art is often on the order of the cost of an entire new piece of furniture and, therefore, has created the situation where furniture with worn upholstery is often discarded rather than having the upholstery repaired.

Additionally, in the furniture of the prior art it has not been possible for the entire upholstery of the furniture to be easily removed and replaced with another set of upholstery having a different color or pattern so as to allow the appearance of the furniture to be easily changed.

These disadvantages of the furniture of the prior art are overcome by the improved furniture construction of the present invention which provides a set of easily removable upholstery panels which are held in place merely by the frictional forces of the press fit of the panels within carefully designed cavities having a close tolerance with the panels.

SUMMARY OF THE INVENTION

An improved furniture construction is provided having a framework designed to receive a series of upholstery panels which are installed merely by press fitting them into place within the framework. The framework includes a side frame having an interior portion with an exterior portion attached to a peripheral edge of said interior portion, said interior and exterior portions defining inner and outer substantially planar cavities having a groove adjacent an edge thereof. Inner and outer side upholstery panels are press fit into the cavities. The outer side panel includes a tongue engaging the groove of said outer cavity. Access holes are provided in said interior portion so that said inner and outer panels may be removed.

It is, therefore, an object of the present invention to provide an improved furniture construction.

Another object of the present invention is the provision of furniture having easily removable upholstery panels.

Another object of the present invention is the provision of an upholstery panel and a framework for receiving said panel wherein the upholstery panel is held in place within the framework by the frictional forces from a close tolerance between the upholstery panel and the framework.

Yet another object of the present invention is the provision of an improved furniture construction having an indefinite economic life due to the low cost of replacing the upholstery thereof.

Another object of the present invention is the provision of a furniture construction having two sets of interchangeable upholstery panels so that, for example, a light color upholstery may be used in summer and a dark color may be used in winter.

And another object of the present invention is the provision of a furniture construction which can be easily disassembled for shipping and the like.

Other and further objects of the present invention will be readily apparent to those skilled in the art, upon a reading of the following description in conjunction with the accompanying drawings.

BRIEF DESCRIPTION OF THE DRAWINGS

FIG. 6 is an elevation view of an inner upholstery panel of the present invention.

FIG. 9 is a sectional elevation view of the outer upholstery panel of FIG. 8 taken along lines 9—9.

FIG. 15 is a sectional elevation view of the furniture construction of FIG. 5 taken along a vertical plane down the center line of the furniture facing the left side frame thereof.

DETAILED DESCRIPTION OF THE PREFERRED EMBODIMENTS

Figure 1:
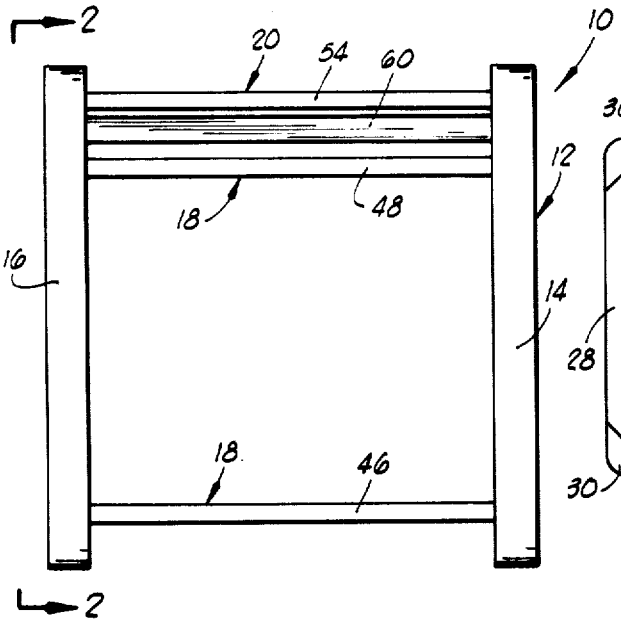
FIG. 1 is a plan view of the framework of the improved furniture construction of the present invention, without any upholstery in place thereon.
Figure 2:
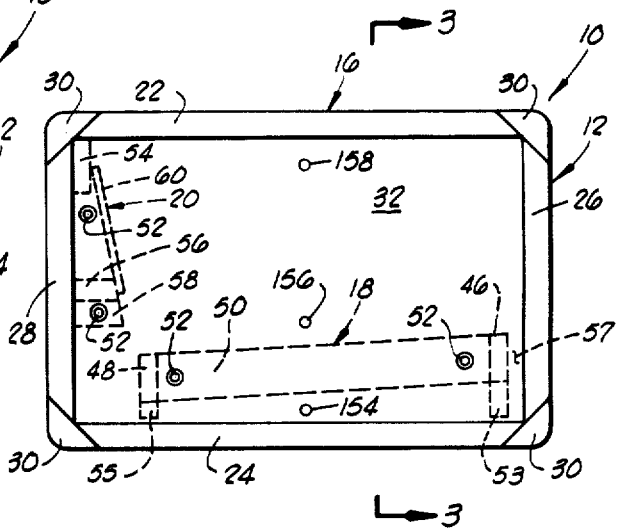
FIG. 2 is a side elevation view of the right side frame of the framework of FIG. 1.

Referring now to the drawings and to particulary FIGS. 1 and 2, an improved furniture construction of the present invention is shown and generally designated by the numeral 10. FIGS. 1 and 2 depict a framework 12 of the furniture 10 without any fabric or upholstery in place thereon.

FIG. 1 shows a plan view of the framework 12. The framework 12 includes left and right side frames 14 and 16, respectively. Also, included is a bottom frame 18 and a back frame 20.

Referring now to FIG. 2, a side elevation view of right side frame 16 along lines 2—2 of FIG. 1 is shown. The bottom frame portion 18 and the back frame portion 20, which are hidden behind right side frame 16, are shown in dashed lines.

Right side frame 16 is rectangular in configuration and includes exterior upper and lower horizontal members 22 and 24, respectively, and exterior front and rear vertical members 26 and 28, respectively.

At the junctions between each of these horizontal and vertical members is a knee portion 30. The interior portion of the right side frame 16 within the members 22, 24, 26, and 28 is a solid planar interior portion 32.

Figure 3:
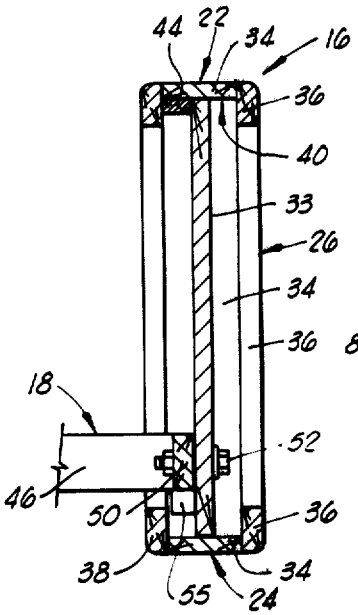
FIG. 3 is a sectional elevation view of the right side frame of FIG. 2 taken along lines 3—3.

Referring now to FIG. 3 a sectional view of right frame 16, taken along line 3—3 of FIG. 2, is shown.

Each of upper, lower, front and rear members 22, 24, 26 and 28, respectively, of right side frame 16 include a middle portion 34 attached substantially perpendicular to an edge of interior portion 32. The middle portions 34 extend both outwardly and inwardly a distance from the outer and inner surfaces 33 and 35, respectively, of interior portion 32.

As used therein, the terms outwardly and inwardly, or outer and inner, refer to placement relative to the central portion of furniture 19, i.e. the location where a person would normally sit on the cushion 70. For example, the outer edge surface 33 of interior portion 32 is further away from the center of the furniture 10 than is the inner surface 35.

Attached to the outer and inner edges of each middle portion 34 are outer and inner edge portions 36 and 38, respectively. The outer and inner edge portions 36 and 38 are mounted upon the middle portion 34 so as to be flush with that surface thereof furthest from interior portion 32 and to extend a distance toward the interior of right side frame 16 so as to form outer and inner grooves 40 and 42, respectively.

Outer groove 40 is defined between interior portion 32, the middle portions 34 and the outer edge portions 36. Inner groove 42 is defined between interior portion 32, the middle portions 34 and inner edge portions 38.

That portion of inner groove 42 adjacent upper horizontal member 22 is partially filled by spacer strip 44, which is located in the upper portion thereof.

The materials for construction of right side frame 16 are as follows. Interior portion 32 is preferably $\frac{1}{2}$ inch plywood. Middle portions 34, and outer and inner edge portions 36, are preferably $\frac{3}{4}$ inch$\times$2 inch hardwood boards.

Referring now to the lower portion of FIG. 3, the connection between bottom frame 18 and right side frame 16 is illustrated. Bottom frame 18 is substantially rectangular in configuration and includes front and rear (see FIG. 1) bottom frame members 46 and 48, respectively. The right ends of members 46 and 48 are connected by right bottom frame member 50. The left ends of members 46 and 48 are similarly joined by left frame member 51 (see FIG. 15).

Front and rear bottom frame members 46 and 48 are preferably constructed from 2 inch$\times$6 inch timbers. The right bottom frame member 50 and the left bottom frame member 51 are preferably constructed of $\frac{3}{4}$ inch plywood.

As is seen in FIGS. 2 and 3, the bottom frame 18 is connected to right side frame 16 by a pair of bolts 52. The bottom frame 18 is positioned by front and rear support blocks 53 and 55, respectively, which are attached to interior portion 32.

As is best illustrated in FIG. 2, front bottom frame member 46 is spaced rearwardly from the front vertical members 26 of left and right side frames 14 and 16, leaving a gap 57 therebetween.

Referring now to FIGS. 1 and 2, the back frame 20 spans side frames 14 and 16 and includes an upper member 54 and a lower member 56 which are attached at their right and left ends to substantially triangular shaped right and left members 58 and 59, respectively. As is shown in FIGS. 2 and 15, each of the side members 58 and 59, of back frame 20, are connected to the interior portions 32 of right and left side frames 14 and 16, by a pair of bolts 52.

Across the front portion of back frame 20 there is mounted a flat back support member 60 which is supported by upper and lower members 54 and 56 and the triangularly shaped side members 58 and 59 of back frame 20.

Upper and lower members 54 and 56 of back frame 20 are preferably constructed of 2 inch$\times$4 inch timbers. Substantially triangular shaped right side members 58 and 59 are preferably constructed of $\frac{3}{4}$ inch plywood. Flat back support member 60 is preferably constructed of $\frac{3}{8}$ inch plywood.

Up to this point only the framework 12 of the improved furniture construction 10 of the present invention has been shown and described. The important purpose of this framework construction is to allow the upholstery, which will now be described, to be easily installed or removed so that the owner of the furniture may readily change the upholstery of the furniture by merely removing one set of panels and replacing them with another set. This is done without the need for removal of any screws, bolts, or the like, and without damaging the upholstery.

Figure 4:
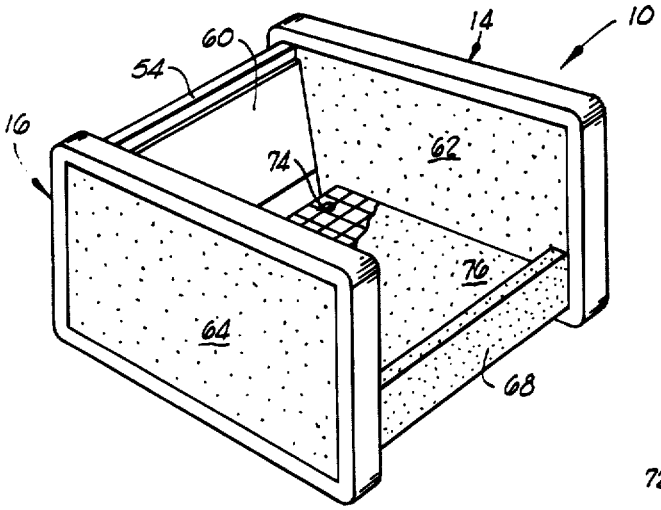
FIG. 4 is an oblique view of the improved furniture construction of the present invention having the front upholstery panel and the inner and outer side upholstery panels in place.
Figure 5:
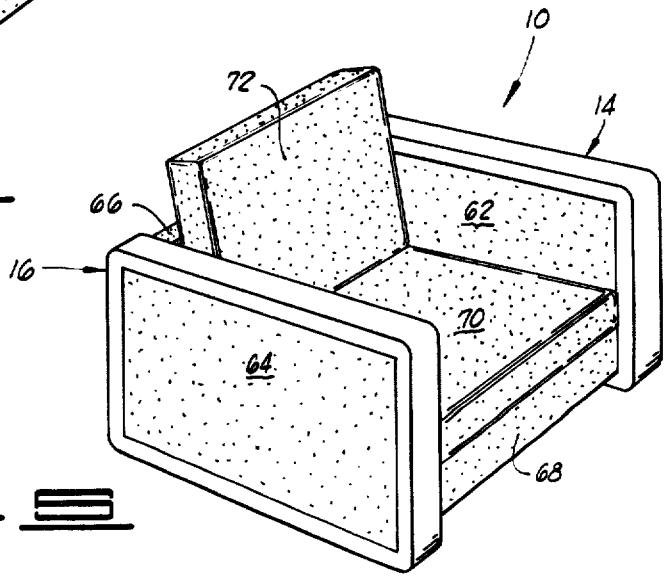
FIG. 5 is an oblique view of the furniture construction of the present invention with all upholstery panels and cushions in place.

Referring now to FIGS. 4 and 5, there are shown two oblique perspective views of the improved furniture construction 10.

FIG. 5 shows the furniture construction 10 with all upholstery panels in place. Each of the left and right side frames 14 and 16 include inner and outer upholstery panels 62 and 64, respectively. Between the left and right side frames 14 and 16 and engaging the back frame 20 is back upholstery panel 66. Between left and right side frames 14 and 16, and engaging front bottom frame member 46, is front upholstery panel 68. Additionally, the bottom frame 18 supports bottom cushion 70 and the back frame 20 supports back cushion 72.

FIG. 4 shows the improved furniture construction 10 with cushions 70 and 72, and back upholstery panel 66 removed. In the view of FIG. 4, the bottom frame 20 is shown to be covered by a conventional seat spring system 74 which is in turn covered by a cloth cover 76.

The details of construction of the various upholstery panels will now be described.

Referring now to FIG. 6, an elevation view is shown of the inner side upholstery panel 62 of the left side frame 14. Inner side upholstery panel 62 has a top edge 78, front edge 80, bottom edge 82 and rear edge 84. Panel 62 also includes a notch 85, between front edge 80 and bottom edge 82. Notch 85 is provided to fit over front upholstery panel 68, as can best be appreciated in viewing FIG. 15.

Figure 7:
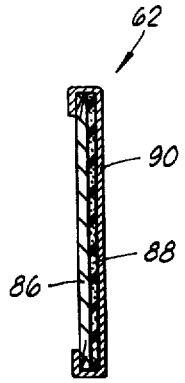
FIG. 7 is a sectional elevation view of the inner upholstery panel of FIG. 6 taken along lines 7—7.
Figure 8:
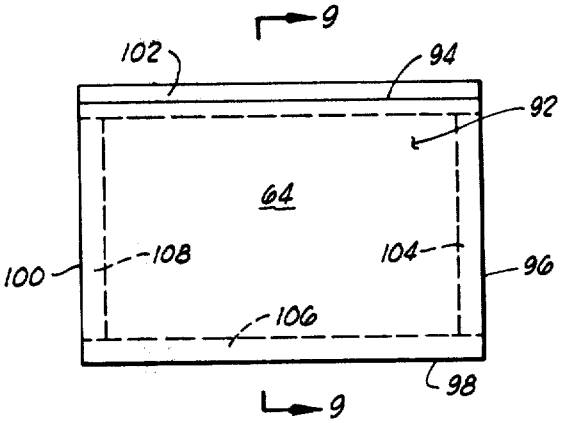
Figure 8:
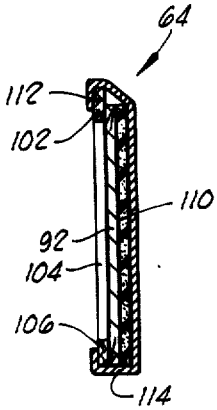

FIG. 7 shows a sectional elevation view of upholstery panel 62 along lines 7—7 of FIG. 6. Inner side upholstery panel 62 includes a flat board 86, of $\frac{3}{8}$ inch particulate board, which is cut to the shape shown in FIG. 6. On the inner side of board 86, and coextensive therewith, is a one-inch thick layer of foam rubber 88. Covering the foam layer 88 and overlapping around the edges of particulate board 86 is a fabric covering 90.

The shape of the inner side upholstery panel 62 is defined by an inner planar cavity, which is itself defined by interior portion 32 of left side frame 14, the upper and front exterior members 22 and 26, the bottom frame 18 and the back frame 20. The panel 62 is dimensioned so that it may be press fit within that inner cavity.

Figure 8:
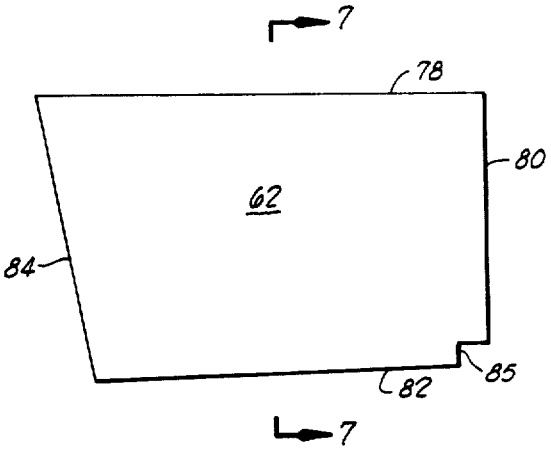
FIG. 8 is an elevation view of an outer upholstery panel of the present invention.

Referring now to FIG. 8, a side elevation view of outer side upholstery panel 64 of right side frame 16, is shown. FIG. 8 illustrates panel 64 without any fabric or foam in place thereon. Panel 64 includes a relatively large interior, planar support member 92, which is a $\frac{3}{8}$ inch thick particulate board having top edge 94, front edge 96, bottom edge 98 and rear edge 100. Attached to the back side of interior board 92 are a top structural strip 102, a front structural strip 104, a bottom strip 106 and a rear strip 108. Each of the strips 102, 104, 106 and 108 are preferably constructed of a strip of particulate board 1 inch$\times\frac{3}{8}$ inch in cross-section.

The shape of the outer side upholstery panel 64 is defined by a substantially rectangular outer planar cavity, which is itself defined by interior portion 32 of right side frame 16 and the exterior members 22, 24, 26 and 28. The panel 64 is dimensioned so that it may be press fit within that outer cavity. The peripheral edges 94, 96, 98 and 100 of the outer side panel 64 engage right side frame 16 about the outer periphery of the outer planar cavity. Outer groove 40 is adjacent and communicates with the peripheral edge of said outer planar cavity. Groove 40 is located inwardly of that portion of exterior members 22, 24, 26 and 28 engaged by said upholstery panel 64.

FIG. 9 shows a sectional elevation view along the lines 9—9 of FIG. 8, with the foam and fabric upholstery now in place. The outer side of interior board 92 is covered with a resilient sheet of $\frac{3}{8}$ inch thick foam rubber 110 which is coextensive with interior board 92. As is seen at the upper portion of FIG. 9, the top particulate strip 102 extends a distance above the top edge 94 of interior board 92 so as to provide a tongue 112 extending upwardly from upholstery panel 64, to be received in outer groove 40. Covering the outer surface of upholstery panel 64 and wrapped around the edges thereof is fabric upholstery covering 114.

Figure 10:
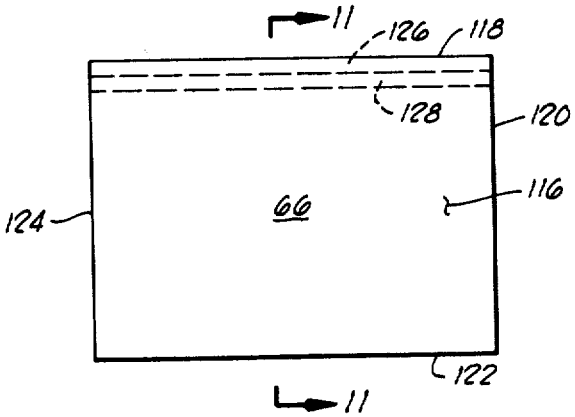
FIG. 10 is an elevation view of the back upholstery panel of the present invention.

Referring now to FIG. 10, an elevation view of back upholstery panel 66 is shown. The view of FIG. 10 does not illustrate the foam rubber and fabric coverings shown in the cross-sectional view of FIG. 11. Back upholstery panel 66 includes a large flat $\frac{3}{8}$ inch thick particulate board 116 having a top edge 118, right edge 120, bottom edge 122 and left edge 124.

Figure 11:
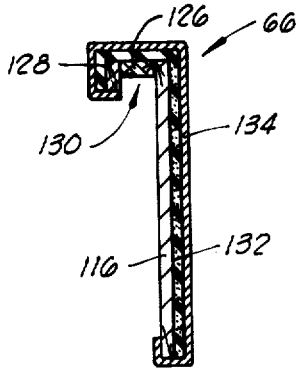
FIG. 11 is a sectional elevation view of the back upholstery panel of FIG. 10 taken along lines 11—11.

FIG. 11 shows a cross-sectional view of back panel 66, taken along lines 11—11 of FIG. 10. Attached to the front surface of board 116, flush with top edge 118 thereof, is a 1 inch$\times$2 inch timber 126, extending horizontally along the entire top edge 118. Attached to the timber 126 is a particulate board strip 128, $\frac{3}{8}$ inch thick$\times 2\frac{1}{4}$ inches wide, one horizontal edge of which is flush with top edge 118 and the other horizontal edge of which extends downwardly to form the groove 130 between the members 116, 126 and 128.

A $\frac{3}{8}$ inch thick sheet of foam rubber 132 covers the back surface of board 116 and wraps around the top edge 118, the timber 126 and the particulate strip 128. The foam rubber sheet 132 is covered by a fabric covering 134 which wraps around the edges of the board 116, the timber 126 and the particulate strip 128.

Figure 12:
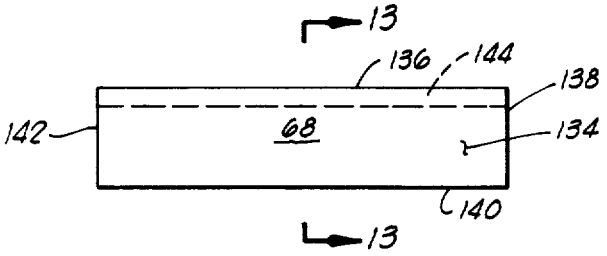
FIG. 12 is an elevation view of the front upholstery panel of the present invention.

Referring now to FIG. 12 an elevation view is shown of front upholstery panel 68. The view shown in FIG. 12 does not illustrate the foam rubber and fabric covering shown in FIG. 13.

Front upholstery panel 68 includes a vertically extending $\frac{3}{8}$ inch particulate board 134 having top edge 136, left edge 138, bottom edge 140 and right edge 142. Attached to the back side of board 134, flush with top edge 136 thereof, is a 1 inch$\times$2 inch timber strip 144 which forms a lip of upholstery panel 68.

Figure 13:
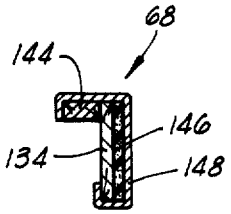
FIG. 13 is a sectional elevation view of the front upholstery panel of FIG. 12 taken along lines 13—13.

Referring to FIG. 13 a sectional elevation view of upholstery panel 68, taken along lines 13—13 of FIG. 12, is shown. The particulate board 134 and timber strip 144 are covered by a $\frac{3}{8}$ inch thick sheet of foam rubber 146 which is in turn covered by fabric covering 148 which overlaps the edges of particulate board 134 and timber strip 144.

Figure 14:
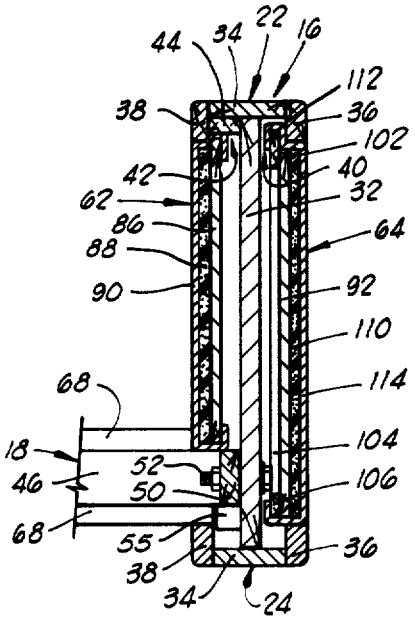
FIG. 14 is a sectional elevation view similar to FIG. 3, showing front upholstery panel, and the inner and outer side upholstery panels in place thereon.
Figure 18:
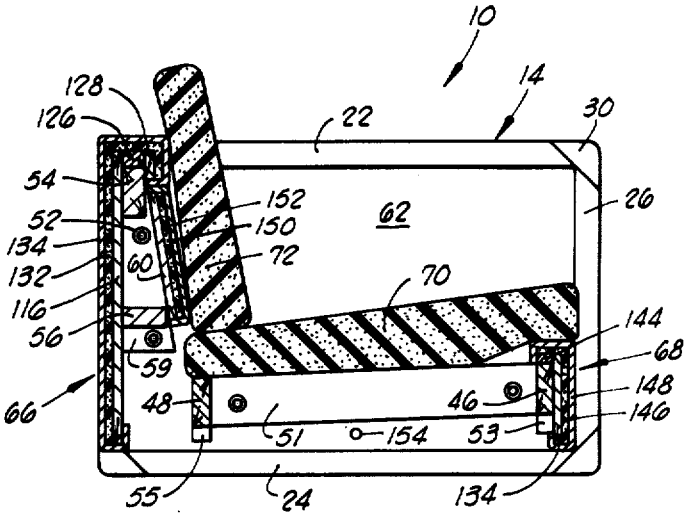

Referring now to FIGS. 14 and 15, the orientation of the various upholstery panels within the improved furniture construction 10, when assembled in the manner shown in FIG. 5, is shown. FIG. 14 is a sectional elevation view similar to that of FIG. 3, with the inner side upholstery panel 62 and the outer side panel 64 in place. The outline of front upholstery panel 68 is also shown. Bottom cushion 70 is not illustrated.

Outer side upholstery panel 64 is installed within right side frame 16 by inserting tongue 112 into outer groove 40, adjacent upper horizontal member 22, and then pressing the remainder of panel 64 into the cavity defined by the outer edge portions 36 of right side frame members 22, 24, 26 and 28. The height and width of interior board 92 of outer upholstery panel 64, as viewed in FIG. 8, are dimensioned so that it will just fit within the cavity defined by outer edge portions 36.

First and second side dimensions, representing the height and width, respectively, of interior board 92 as seen in FIG. 8, are slightly smaller than corresponding first and second side dimensions, respectively, of the rectangular planar outer cavity defined between exterior members 22, 24, 26 and 28 of right side frame 16 as seen in FIG. 2. This close tolerance is added to by the fabric covering 114 and the resilient force applied thereto by foam sheet 110. This close tolerance, combined with the frictional force provided by the fabric 114 engaging the outer edge portions 36 and being resiliently urged thereagainst by the foam sheet 110, provides sufficient force to hold upholstery panel 64 in place as shown in FIG. 4.

The installation of inner side upholstery panel 62 will now be described. The inner side upholstery panel 62 of right side frame 16 is the mirror image of inner side upholstery panel 62 of left side frame 14 illustrated in FIG. 6. It is noted that front upholstery panel 68 should be installed prior to installing inner side panel 62. The top edge 78 (see FIG. 6) is inserted within groove 42 and the remainder of inner side upholstery panel 62 is then pressed into place into the position shown in FIG. 14. Panel 62 is dimensioned so as to closely fit within a cavity defined by inner edge portions 38 of upper horizontal member 22 and front vertical member 26 of right side frame 16, the top surface of bottom frame 18, and the front surface of flat back support member 60. This close tolerance, combined with the foam sheet 88 and the fabric covering 90, operate in a manner similar to that just described for outer side upholstery panel 64 to provide a snug press fit of inner side upholstery panel 62 within the cavity just defined so that it will remain in that position.

Referring now to FIG. 15 a sectional elevation view of the furniture of FIG. 5, taken along a vertical plane cutting through cushions 70 and 72 and facing left side frame 14, is shown.

The installation of front upholstery panel 68 will next be described. The board portion 134 of panel 68, along with the foam sheet 146 and fabric covering 148 coextensive therewith, are inserted in the gap 57 between front bottom frame member 46 and the front vertical members 26 of each of the side frames 14 and 16. Front upholstery panel 68 is pushed downward into the gap 57 until the timber strip 144 engages the top of front bottom frame member 46.

The installation of back upholstery panel 66 is as follows. The groove 130 is dimensioned so as to snugly fit over the top edge of upper member 54 of back frame 20 as shown in FIG. 15. The board member 116 of back panel 66 extends vertically downward to a point approximately level with the top edge of lower horizontal members 24 of the side frames. The board 116 also engages the back edge of lower member 56 of back frame 20 as shown.

Also, illustrated in FIG. 15 are some additional features of back frame 20. The flat back support member 60 is shown to have a ⅜ inch thick foam sheet 150 coextensive with the front surface thereof. The foam sheet 150 is covered by a fabric covering 152.

ASSEMBLY OF DISASSEMBLY

In summary, the improved furniture construction 10 is arranged so that the upholstery panels 62, 64, 66 and 68 may be readily installed or removed from the framework 12 in a rapid and easy manner. The installation of the upholstery panels upon the framework 12 is as follows. The front upholstery panel 68 is first press fit into gap 57 and between side frames 14 and 16 as shown in FIG. 15. Then the two inner side upholstery panels 62 are press fit into the inner planar cavities as shown in FIG. 14. Then the back upholstery panel 66 is press fit over upper back frame member 54 and between side frames 14 and 16 as shown in FIG. 15. The cushions 70 and 72 are then placed as shown in FIG. 15. Then the outer side upholstery panels 64 are press fit into the outer planar cavities with tongues 112 engaging outer grooves 40 as shown in FIG. 14.

The removal of the upholstery panels from the framework 12 is easily achieved by means of three access holes 154, 156 and 158 drilled through the interior portions 32 of each of the side frames 14 and 16. These access holes 154, 156 and 158 are respectively referred to as a lower access hole and first and second upper access holes. The order of removal of the panels and the method of the removal is as follows. A screwdriver or similar instrument is inserted through the access hole 154 of left side frame 14 from the under side of the furniture 10 and is pressed against the lower portion of outer upholstery panel 64, urging panel 64 away from the left side frame 14 so that its bottom edge 98 may be grasped with the hand to pull the outer upholstery panel 64 from the left side frame 14.

The outer upholstery panel 64 of right side frame 16 is removed in a similar manner.

After removal of the outer side upholstery panels 64, the inner side upholstery panels 62 may then be removed in similar manner by inserting the screwdriver through access holes 156 or 158 to push inner panels 62 away from their respective side frames so that the bottom edges 82 of the inner panels 62 may be grasped with the hand and the panels pulled from their side frames. The cushions 70 and 72 should, of course, be removed prior to removal of the inner side panels 62.

Next, the back upholstery panel 66 and the front upholstery panel 68 may be removed by merely lifting them from the position in which they are located.

In this manner the upholstery of the improved furniture construction 10 may be removed for cleaning, repair, or merely for exchanging with another set of upholstery panels, and may be similarly replaced in a simple and easy manner.

It will be apparent to those skilled in the art that the improved furniture construction of the present invention can be applied to numerous types of furniture including chairs, ottomans, sofas, portable bars and the like.

Thus, the improved furniture construction of the present invention is well adapted to carry out the objects and obtain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An improved furniture construction, comprising:

a frame, having a planar cavity therein, said cavity including an outer periphery substantially defined by said frame; and an upholstery panel having a peripheral edge engaging said frame about the outer periphery of said planar cavity, and having a shape defined by said cavity and being dimensioned so that said panel may be press fit into said cavity and retained therein by the frictional force of said press fit.

2. The improved furniture construction of claim 1, wherein said panel comprises:

a planar support member, having a shape substantially defined by said planar cavity;

a layer of resilient material; and an upholstery covering, engaging said layer of resilient material, and covering said peripheral edge of said panel, so that the frictional force between said panel edge and said frame is sufficient to retain said panel in place within said planar cavity.

3. The improved furniture construction of claim 2, wherein:

said frame further includes a groove, adjacent and communicating with the peripheral edge of said cavity; and said panel further includes a tongue, constructed to be received in said groove.

4. The improved furniture construction of claim 3, wherein:

said tongue includes a structural strip, partially coextensive with and overlapping a portion of said peripheral edge of said panel adjacent said groove.

5. The improved furniture construction of claim 4, wherein:

said panel further comprises a second structural strip, attached to the same side of said panel as said first strip and positioned coextensively with a portion of said panel and substantially flush with the peripheral edge of said panel.

6. The improved furniture construction of claim 1, wherein:

said frame further comprises a groove, disposed therein adjacent said cavity; and said panel includes a tongue for engagement with said groove.

7. An improved furniture construction, comprising:

a frame, having an interior portion and an exterior frame member attached to an edge of said interior portion, said interior portion and exterior member substantially defining a planar cavity in said frame, said cavity including an outer periphery substantially defined by said exterior frame member; and a planar upholstery panel, constructed so that it may be press fit into said planar cavity and retained therein by frictional force between a peripheral edge of said panel and said exterior frame member at said outer periphery of said cavity.

8. The improved furniture construction of claim 7, further comprising:

an access hole, disposed in said interior portion, so that said upholstery panel may be removed by inserting an instrument through said access hole to engage said panel.

9. The improved furniture construction of claim 7, wherein:

said frame is substantially rectangular and said planar cavity is a substantially rectangular planar cavity.

10. The improved furniture construction of claim 9, wherein:

said frame includes a groove disposed along the peripheral edge of said cavity; and said panel includes a tongue, said tongue engaging said groove to retain said panel within said cavity.

11. The improved furniture construction of claim 10, wherein said panel further comprises:

a planar rectangular interior member, having an inner and outer surface, and having first and second side dimensions slightly smaller than corresponding first and second side dimensions of said planar rectangular cavity, respectively;

a strip member, attached to said inner surface of said interior member of said panel, and extending past an edge thereof to form said tongue;

a sheet of resilient material, coextensive with said outer surface of said interior member of said panel; and upholstery, covering said resilient sheet and covering the edges of said interior and strip members of said panel, said panel being dimensioned so that said upholstery edges will closely engage the portions of said frame member defining the peripheral edge of said substantially rectangular planar cavity.

12. The improved furniture construction of claim 11, wherein:

said groove is located inwardly of that portion of said exterior frame member which is engaged by said interior member of said panel.

13. The improved furniture construction of claim 10, wherein said exterior frame member comprises:

a middle portion, attached to the edge of said interior portion of said frame, and extending a distance outward from an outer surface of said interior portion; and an outer edge portion, attached to an outer edge of said middle portion and extending a distance toward the interior of said frame, thereby forming said groove.

14. The improved furniture construction of claim 7, wherein:

said planar cavity is a first outer planar cavity; and said frame interior portion and said outer frame member further define a second inner planar cavity, for receiving a second inner upholstery panel.

15. An improved furniture construction, comprising:

a framework, having a bottom frame, a back frame and first and second side frames;

an inner side upholstery panel, press fit within an inner cavity, substantially defined by said bottom frame, back frame and first side frame; and an outer side upholstery panel, press fit within an outer cavity, disposed in said first side frame.

16. The apparatus of claim 15, wherein:

said first side frame has disposed therein a lower access hole, located below said bottom frame, so that an instrument may be inserted through said access hole to engage said outer side upholstery panel and push an edge thereof out of engagement with said first side frame.

17. The apparatus of claim 10, wherein:

said first side frame has disposed therein an upper access hole, located above said bottom frame, so that after removal of said outer side upholstery panel, an instrument may be inserted through said upper access hole to engage said inner side upholstery panel to push an edge of said upholstery panel out of engagement with said first side frame.

18. The apparatus of claim 15, further comprising:

a front upholstery panel, press fit into a gap between said bottom frame and said side frames, said front panel having a lip engaging an upper surface of said bottom frame.

19. The apparatus of claim 15, further comprising:

a back upholstery panel, having a groove therein closely engaging a member of said back frame spanning said first and second side frames.

20. An improved furniture construction, comprising:

a rectangular bottom frame, having front and rear bottom frame members;

first and second side frames, each having a rectangular planar interior portion, and upper, lower, front and rear exterior members defining inner and outer planar cavities, with a groove adjacent an edge of each of said cavities, said interior portion having disposed therein upper and lower access holes located above and below said bottom frame, respectively, and said front frame members of said side frames being spaced from said front bottom frame member forming a gap therebetween;

a back frame, having a member spanning said first and second side frames;

a front upholstery panel, positioned in said gap between said bottom and side frames, said front panel having a lip engaging an upper surface of said front bottom frame member;

a back upholstery panel, having a groove therein for receiving said spanning member of said back frame;

an inner side upholstery panel, positioned within said inner planar cavity of each side frame; and an outer side upholstery panel, positioned within said outer planar cavity of each side frame.

21. The improved furniture construction, wherein:

said front upholstery panel is press fit into said gap and between said first and second side frames;

said back upholstery panel is press fit between said first and second side frames;

each of said inner side upholstery panels are press fit into one of said inner cavities which are further partially defined by said bottom and back frames; and each of said outer side upholstery panels includes a tongue and said outer panels are press fit within said outer cavities with said tongues engaging said grooves.

* * * * *